US005595628A

United States Patent [19]

Gordon et al.

[11] Patent Number: 5,595,628

[45] Date of Patent: Jan. 21, 1997

[54] PRODUCTION OF PULP BY THE SODA-ANTHRAQUINONE PROCESS (SAP) WITH RECOVERY OF THE COOKING CHEMICALS

[75] Inventors: Otto W. Gordon, Apples; Eric Plattner, Seltisberg; Frank Doppenberg, Lausanne, all of Switzerland

[73] Assignee: Grant S.A., Lausanne, Switzerland

[21] Appl. No.: 170,364

[22] PCT Filed: Apr. 30, 1993

[86] PCT No.: PCT/CH93/00108

§ 371 Date: Jan. 5, 1994

§ 102(e) Date: Jan. 5, 1994

[87] PCT Pub. No.: WO93/22492

PCT Pub. Date: Nov. 11, 1993

[30] Foreign Application Priority Data

May 5, 1992 [CH] Switzerland ..... 1434/92

[51] Int. Cl.[6] ..... D21C 11/04

[52] U.S. Cl. ..... 162/30.11; 162/29; 162/50; 162/72; 162/76

[58] Field of Search ..... 162/29, 31, 30.11, 162/72, 76, 90, 50

[56] References Cited

U.S. PATENT DOCUMENTS

| | | | |
|---|---|---|---|
| 3,490,990 | 12/1966 | Johnson | 162/76 |
| 4,093,508 | 6/1978 | Henricson | 162/30 K |
| 4,138,312 | 2/1979 | Gill et al. | 162/30 R |
| 4,213,821 | 7/1980 | Vanderhoek et al. | 162/72 |

FOREIGN PATENT DOCUMENTS

| | | |
|---|---|---|
| 347904 | 2/1928 | Belgium . |
| 989558 | 5/1976 | Canada . |
| 1222603 | 6/1987 | Canada . |
| 1046466 | 12/1958 | Germany . |
| 1526621 | 9/1978 | United Kingdom . |
| 9322492 | 11/1993 | WIPO . |

OTHER PUBLICATIONS

Zimmermann, F. J. "The Zimmermann Process . . . Paper Industry", Tappi vol. 43, No. 8, Aug. 1960, pp. 710–715.

*Primary Examiner*—Donald E. Czaja
*Assistant Examiner*—Dean T. Nguyen
*Attorney, Agent, or Firm*—Ladas & Parry

[57] ABSTRACT

A process for the production of cellulose from wood and annual plants is provided where the digesting liquor contains free caustic soda, sodium salts of alkyl benzenesulfonic acids, and of aromatic or aliphatic carboxylic acids. By the addition of anthraquinone or its derivatives to the digesting liquor, the delignification is improved. Anthraquinone is resistant to wet oxidation and can be reintroduced into the digesting process. The solubility and, therefore, the effectiveness of anthraquinone is improved by the use of sulfonic acid salts. For the recovery of the digesting chemicals contained in the black liquor, solubilized liquor is precipitated with mineral acid or carbon dioxide and the hemicelluloses are separated by ultra filtration. The resins are separated by extraction with the residual organic compounds, except for the sulfonates and carboxylics, being burned in an aqueous phase with air and/or oxygen. The solution of chemicals containing no further wood decomposition products can, by caustification of the carbonates, be transformed into caustic soda and after partial crystallization of the aliphatic carboxylics used for the cycle of pulp production. The sodium acetate isolated by crystallization can, by membrane electrolysis, be split into acetic acid and sodium hydroxide. The caustic soda is reintroduced to the digesting process, while the acetic acid is treated separately.

28 Claims, No Drawings

PRODUCTION OF PULP BY THE SODA-ANTHRAQUINONE PROCESS (SAP) WITH RECOVERY OF THE COOKING CHEMICALS

DESCRIPTION OF THE PROCESS

The invention is related to a process which allows the production of pulp starting from different sorts of wood like hardwoods and softwoods and also from annual plants, with the possibility to recycle the cooking chemicals contained in the black liquors.

For the production of pulps, the Sulfate process (S. V. Rydholm, Pulping Processes (1965), p. 576 af) and the Sulfite process (S. V. Rydholm, Pulping Processes (1965) p. 439 af) are most frequently used. The Sulfite process has the disadvantage that technical data of pulps do not reach required quality levels; the Sulfate process has mainly the disadvantage of generation of bad smells. For all processes, special care has to be taken for the recovery of cooking chemicals so as to render complete process economical. The recovery of inorganic cooking chemicals is normally achieved by burning the organic compounds from the black liquor with subsequent preparation of the inorganic cooking chemicals.

During the last years, Organosolv processes have come to topic and partly also to realization (Pazner L. and Chang P. C., Canadian pat. 1,201,115, 1986, U.S. Pat. No. 4,470,851, 1984, (Kleinert, T. N. U.S. Pat. No. 3,585,104, Jun. 15, 1971), Dahlmann G., Schroeter M. C., Tappi Journal Vol. 73, No. 4, April 1990), (Cowan W. F. et al, German pat. 26 37 449, Dec. 15, 1988). The disadvantage of these processes is mainly the inflammable, volatile solvents like methanol and ethanol are used, which leads to relative high pressures in the cooking vessels and requires explosion-proof equipment. If sodium hydroxide is used in addition, it is necessary to use a recovery boiler for the recovery of inorganic cooking chemicals, which maintain high equipment costs. If no sodium hydroxide is used for the cooking, only hardwoods and annual plants can be treated.

Pulp processes where aqueous solutions with high concentrations of, for example, sodium benzoate or cymene sulfonate are used have as well to be mentioned. (Lindau, N. N., Naturwissenschaften, 20, 396 (1932); Pelipetz, M. G. Dissertation Columbia Univ. 1937). Recovery processes are particularly important for those highly concentrated cooking chemicals, but are up to now unknown. A further disadvantage of these hydrotropic processes is that lignin has the tendency to precipitate on the fibers during washing of the pulp with water. Organosolv processes also include pulping with organic carboxylic acids like formic acid or acetic acid (Buchholz und Jordan 1983. Nimz und Casten, 1986). The corrosive properties of the cooking chemicals are difficult to evaluate in this case.

Wet oxidation has already been proposed as a recovery process for the cooking chemicals of the Kraft process (F. J. Zimmermann, D. G. Diddams, TAPPI, Vol. 43, August 1960, No. 8) . Therein it was tried to burn completely, the organic compounds contained in the cooking liquors of the Sulfite resp. the Sulfate process, whereas all sulfites resp. sulfides were oxidized to sulfates, which sets the need for a reduction with BaS (barium sulfide) in the case of sulfate liquors to get back to the desired composition of the cooking liquor.

It was found surprisingly that wood could be pulped in an aqueous solution of the alkali salts of several alkyl benzol sulfonic acids, described as hydrotropic salts, and of sodium hydroxide, in conditions that are similar to the kraft process. The addition of anthraquinone up to 0,2% counted on wood is considered as well known for different pulp production processes. For example, for the soda process, for the Kraft process and for the Organocell process.

Anthraquinone is considered as a catalyst for the delignification. The advantages of this addition lies in the extent of the delignification, which eases the bleaching process.

The disadvantage of the anthraquinone addition is that no useful recovery process exists for anthraquinone.

The problem which appeared was to find an economical recovery process for sodium hydroxide, anthraquinone and the hydrotropic salts.

With the help of the partial aqueous phase oxidation it is possible to burn lignin and other wood degradation products and to leave unburnt in the solution the hydrotropic salts and the alkaline salts of the aliphatic carboxylic acids, in particular acetate that are formed during the cooking process and during oxidation, whereas remaining alkali hydroxide is turned into carbonates and bicarbonates. The carbonates and the bicarbonates are turned back into alkali hydroxide with calcium oxide so that the desired composition of the cooking liquor can be reached after crystallization of a part of the acetate and addition of a quantity of alkali corresponding to the crystallized acetate.

Surprisingly, it has been found that anthraquinone besides the possibly used carboxylic acids and hydrotropic salts is resistant against wet oxidation, whereas lignin, hemicelluloses, sugars and resins are burnt.

The recovery is in this case possible and the quantitative limitation of the anthraquinone addition because of its high prices is eliminated.

By using hydrotropic salts in the alkaline cooking liquor, the solubility of anthraquinone is raised and its action on the delignification is reinforced.

The advantage of this process is that it can be run completely free of sulfide and sulfite ions and free of smells, whereas existing equipment, as used for the Kraft cooking process, can be used for this new process. The costly reductive black liquor boiler with recovery of energy can be replaced by the wet oxidation, which represents a considerable reduction of the investment.

Compared to the alcohol processes, the advantage is that no explosion protection is necessary, and in addition the pressures during cooking process are between 6 and 8 bar as for the Kraft process. The recovery system for the alcohol as well as the energy consuming black liquor concentration before the recovery boiler will be avoided. In the process which is described in this patent, the wood chips are introduced into a continuous pulp digester through a charging system and cooked with a solution of sodium hydroxide with addition of anthraquinone and possibly hydrotropic salts during 50 minutes to 2 hours at temperatures from 120° C. to 200° C. at the resulting pressure, washed in counter current with water and discharged into the blow-pit. The cooking process can also be processed discontinuously. The following process of unbleached or bleached pulp is well known technology.

The cooking liquor (black liquor) which contains the cooking chemicals besides lignin, hemicelluloses, sugars, resins and also degradation products has to be treated to eliminate colored extraction products before returning to the cooking process.

After the cooking process conducted as in the patent claims, the black liquor is treated by a partial wet oxidation process which allows the combustion of the organic substances without oxidizing, as could surprisingly be established, the hydrotropic salts, anthraquinone and the low molecular carboxylic acids like acetate.

The sodium hydroxide which was bound to oxidizing organic substances is transformed in that way into inorganic sodium bicarbonate and carbonate. This partial oxidation takes place in aqueous phase with air, oxygen or a mixture of both, under pressure and at high temperature.

This wet oxidation can be conducted continuously or discontinuously in a reactor under strong agitation, at pressures ranging from 20 to 300 bar and at temperatures ranging from 120° C. to 350° C., with introduction of the oxidizing agent, during 5 to 60 minutes.

The gaseous oxidation products and inert gases which come out of the reactor together with steam are treated separately.

The liquid treated by partial wet oxidation and coming out of the reactor contains, besides the sodium carbonates and bicarbonates, the hydrotropic salts, the sodium salts of the carboxylic acids, particularly the acetic acid, and anthraquinone in solid form, which is separated by filtration.

This solution is, after hearing in order to transform the bicarbonates into carbonates, made alkali with calcium oxides in a sodium hydroxide solution of the carboxylic acids, especially of acetic acid and hydrotropic salts. The calcium carbonate is precipitated.

After separation by sedimentation of the calcium carbonate coming from the caustification the recovered cooking liquor is returned to the pulp cooking process after concentration and partial crystallization of the carboxylic acid salts, especially the sodium acetate.

This partial oxidation in aqueous phase also liberates a substantial amount of thermal energy, which can be used for the concentration of the cooking liquor, but also for the cooking process itself.

Before the wet oxidation, it is possible, by introduction of carbonic acid or combustion gas, to precipitate the dissolved lignin and separate it from the black liquor. This lignin is then available as market product.

This precipitation of lignin can nevertheless also be achieved by acetic acid, which has the advantage that lower pH values and thus more complete precipitation can be reached. If lignin is precipitated by acetic acid, it is advantageous to add sodium hydroxide before the wet oxidation, so that the pH of the solution reaches 7–8 after wet oxidation. If lignin is precipitated by acetic acid, it is to possible to renounce to the causticizing process with calcium oxide. It is then necessary to split the sodium acetate to sodium hydroxide and acetic acid by membrane electrolysis or electrodialysis, after crystallization, separation and redissolution. The sodium hydroxide is again returned to the cooking process, acetic acid is used for precipitation of lignin, the surplus is sold. The crystallization of sodium acetate can even be avoided, if the wet oxidized liquor is treated with the necessary amount of acetic acid to cook away the carbonates and, after separation of small quantities of solid matter, is directly submitted to membrane electrolysis where only the necessary amount of sodium hydroxide for the cooking and oxidation process and corresponding amount of acetic acid are split.

In case hydrotropic salts were used during the cooking process, these salts remain with the acetic acid on the anode side of the membrane electrolysis cell, the separation of the acetic acid can be achieved by known processes like distillation or extraction. The anode solution is then mixed with the sodium hydroxide to form again the composition of the cooking liquor for the pulp cooking process.

It is likewise possible to recover the resin by extraction from the black liquor, before the latter is submitted to wet oxidation.

It is known that, during the cooking process from wood to pulp, carboxylic acids are formed from lignins resp. hemicelluloses, and are present in the black liquor in the form of sodium salts. It is possible with the help of the selective wet oxidation to treat hemicellulose in order to form mostly carboxylic acids. (File 399 CA SEARCH—1967–1992—UD=11614, item 10). It is although proposed to treat and to recycle, resp. to sell, those carboxylic acids, in particular the acetic acid in the form of its sodium salt, according to the proposed process.

EXAMPLES

Example 1

Wood chips from black spruce without bark contents were introduced into an autoclave together with four times their weight of digesting liquor and heated up in an oil bath during 60 minutes to a temperature of 170° C. and held at this temperature during 120 minutes. After cooling to 40° C. and opening of the autoclave, the black liquor has been decanted. The composition of the digesting and black liquors are given in Table I:

TABLE I

The chemicals are given in wt. % of the digested dry wood.

| | digesting liquor | black liquor | green liquor | white liquor |
|---|---|---|---|---|
| NaOH | 19.0 | 19.0 | — | 9.0 |
| CO2 | — | — | 4.9 | — |
| Na2CO3 | — | — | 11.9 | — |
| CH3COONa | — | — | 20.5 | 20.5 |
| Wood components* | — | 45.5 | — | — |
| Anthraquinone | 0.14 | 0.14 | 0.14** | — |

*without Alkali
**is filtered

The fibrous part was washed with hot water and has been analyzed.

The Kappa number was determined at 28.

The combined filtrate and wash-water was introduced in the oxidation reactor. After heating up to 280° C. at a pressure of 200 bar, the oxidation has been done by introduction of air in the reactor during 10 minutes. With the energy liberated in the oxidation it was possible to reduce the volume of the liquor by evaporation to approximately half of the volume of the black liquor.

After filtration of anthraquinone, the result was a slightly yellow liquid, called green liquor, that after heating up to boiling temperature was mixed with 83 g of calcium hydroxide per kg dry wood. The precipitated calcium carbonate was separated by sedimentation. The composition of the residual liquor, called white liquor, and the green liquor are given by table I.

The resulting liquid was after addition of a quantity of sodium hydroxide corresponding to sodium acetate and recycling of the anthraquinone adapted to the right concentration and reintroduced to the digesting process.

Example 2

After several cycles as described in Example 1, the compositions of the digesting, black, green and white liquor show the value contained in table II.

TABLE II

| | digesting liquor | black liquor | green liquor | white liquor*** |
|---|---|---|---|---|
| NaOH | 19.0 | 19.0 | — | 9.0 |
| CO2 | — | — | 4.9 | — |
| Na2CO3 | — | — | 11.9 | — |
| CH3COONa | 44.0 | — | 64.5 | 44.0 |
| Wood Components* | — | 45.5 | — | — |
| Anthraquinone | 0.14 | 0.14 | 0.14** | — |

*without Alkali
**is filtered
***after separation of CH3COONa.3H2O

Before the reintroduction of the white liquor into the digesting process, it is concentrated to a dry matter content of 38.5%. By cooling to 20° C., 340 g Sodium acetate trihydrate per kg of dry wood are crystallized. A quantity of caustic soda corresponding to the isolated acetate is added to the starting liquor that is then after adjusting of the concentration reintroduced into the digesting process. The overall loss of alkali, without taking into account of the sodium acetate, is 5%.

Example 3

Beechwood chips without bark was together with five times the quantity of digesting liquor of the following composition, introduced into an autoclave.

18% wt. NaOH, 20% wt. sodium toluenesulfonate, based on wood and the sodium acetate concentration resulting after several cycles. In an oil-bath the inside temperature was increased during 60 minutes to 170° C. and was held at this level during 2 hours.

After temperature reduction and decanting, the resulting pulp was washed with hot water. The pulp yield was 52% wt., calculated on wood. The kappa number was 22, the DP at 1800. The black liquor was treated with $CO_2$ and the main part of the lignin was precipitated, filtered and washed. 12% wt. lignin calculated on wood could be obtained.

The mixture of filtrate and wash-water of the lignin filtration was subjected to the wet oxidation process at a temperature of 220° C., a pressure 180 bar, with oxygen during 15 minutes.

The volume of the liquid was reduced by the resulting energy to 80% of the volume before mixing with the wash water of the lignin filtration. After transformation of sodium bicarbonate to sodium carbonate 104 g calcium hydroxide per kg of wood were added to the solution in order to transform the sodium carbonate into sodium hydroxide, whereas the calcium carbonate was separated by sedimentation. The solution was concentrated up to a dry matter content of 45%.

By cooling of this solution, 227 g sodium acetate trihydrate per kg of wood could be crystallized and separated.

After having dissolved again the sodium acetate, the caustic soda was, by electrodialysis, separated for the renewed utilization in the digesting process. The resulting acetic acid can be used for other purposes.

The resulting solution (including caustic soda from the electrodialysis) had the following composition: 16.5% wt. NaOH, 18.5% wt. sodium toluenesulfonate, 3.5% wt. sodium acetate, calculated on dry wood.

After adjusting of the concentration this solution was used for the digesting process with the same result as described before. The loss of digesting chemicals was 8%.

Example 4

Softwood chips were mixed with digesting liquor (20% wt. NaOH, 30% wt. sodium xylenesulfonate, isomeric mixture, 20% sodium acetate from an earlier test and 0.2% sodium 2-anthraquinonesulfonate as the Na-salt) and kept during 100 minutes at 180° C.

The pulp yield after washing was 56.7% wt. calculated on dry wood. The kappa number was 28, the DP 1900.

Out of the black liquor lignin was precipitated with acetic acid. After filtration and washing, 18% wt. of lignin calculated on wood were obtained.

To the mixture of filtrate and wash-water some sodium hydroxide was added and subjected to wet oxidation at 260° C. and 180 bar during 15 minutes.

After wet oxidation, the pH was 7,5. The compositions of the black liquors (before and after lignin precipitation) as well as of the green liquor are summarized in table III.

TABLE III

| | black liquor | | | |
|---|---|---|---|---|
| | before lignin | after separation | green liquor | white liquor |
| NaOH | 19 | +5 | — | 24 |
| CO2 | — | — | 3 | — |
| CH3COONa | 20* | 58 | 68 | 19 |
| Na-xylenesulfonate | 29 | 28 | 28 | 28 |
| Wood components** | 43 | 25 | — | — |
| Na-2-AQ-sulfonate | 0.2 | 0.19 | 0.19 | 0.19 |

*from an earlier charge
**without Alkali

The cleared green liquor was introduced to the anodic part of a membrane electrolysis cell, on the other side water flows to the cathodic part. Caustic soda and a mixture of sodium xylenesulfonates, sodium acetate and acetic acid (in a quantity equivalent to the caustic soda) is recovered from the cell.

After separation of the acetic acid, for example by distillation, the anodic liquid is mixed with the recovered alkali and after adjustment of the concentration used as digesting liquor. The acetic acid is used for lignin precipitation, the surplus (80 g per kg of wood) can be used for other purposes.

The composition of green and white liquors are as well described in table III.

The loss of chemicals is corresponding to approximately 5%.

Example 5

Wheat straw chips were mixed with digesting liquor in a ratio of 1 to 5, calculated on dry matter, and maintained at 170° C. during 100 minutes.

The resulting yield of cellulose, after washing and screening of the fibers, was 45% calculated on dry matter. The waste generated during the screening of about 5% is mixed to the black liquor that is subjected to wet oxidation with air at 280° C., 200 bar and 7 minutes. By filtration of the oxidized green liquor, anthraquinone with small amounts of inorganic substances was recovered. After recausticizing, the white liquor is concentrated to 38.5% dry matter and by cooling to 20° C., 360 g of sodium acetate trihydrate per kg of dry wheat straw are isolated. This salt can either be used outside of the digesting process, in this case a quantity of caustic soda equivalent to the isolated sodium acetate shall be added for the recycling in the digesting process, or the caustic soda can, after an electrodialysis of the again dissolved salt, be reintroduced into the digesting process. The acetic acid produced herein will be used elsewhere than in the digesting process.

The compositions of the various liquors can be seen in table IV. The loss of chemicals per digesting cycle is 5%.

We claim:

1. A process for producing pulp from wood and annual plants and recovering of digesting chemicals thereof, the process comprising:

(a) cooking wood and annual plants with a digesting white liquor comprised of water, sodium hydroxide, anthraquinone and one or more alkali salts selected from the group consisting of aromatic carboxylic acids, aliphatic carboxylic acids and organic sulfonic acids, to produce pulp and black liquor; and (b) recovering the digesting chemicals contained in the black liquor by:

(i) partially oxidizing the black liquor in a water phase without substantially oxidizing the organic sulfonic acids, aliphatic carboxylic acids, and anthraquinone, wherein the lignin, hemicelluloses and sugars are oxidizedinto aliphatic carboxylic acids and carbon dioxide and the sodium hydroxide is converted to sodium carbonate and/or sodium bicarbonate, (ii) removing the insoluble anthraquinone from the oxidized liquor, (iii) heating the oxidized liquor to transform sodium bicarbonate into sodium carbonate;

(iv) converting the sodium carbonate formed in the heated oxidized liquor into sodium hydroxide in a causticizing stage, and (v) separating the sodium salts of aliphatic carboxylic acids from the causticized liquor by one of the following steps:

(a1) crystallizing the causticized liquor to remove the sodium salts of aliphatic carboxylic acids; and (a2) crystallizing the causticized liquor to remove the sodium salts of aliphatic carboxylic acids from the liquor, re-dissoluting the remaining liquor in water and then subjecting re-dissoluted liquor to a membrane electrolysis or electrodialysis to further separate the sodium hydroxide from residual sodium salts of aliphatic carboxylic acids.

2. A process as claimed in claim 1 further comprising the use of a derivative of anthraquinone, the derivative being selected from the group consisting of 2-methyl-anthraquinone, 2-anthraquinone sulfonate sodium salt and 2,6-anthraquinone disulfonate disodium salt.

3. The process as claimed in claim 1 wherein the digesting liquor is comprised of:

(a) 3%–30% weight of sodium hydroxide with respect to the weight of the wood and annual plants;

(b) 20%–70% weight of alkali salts selected from the group consisting of organic sulfonic acids, aromatic carboxylic acids, aliphatic carboxylic acids, with respect to the weight of the wood and annual plants; and (c) 0.7%–2% weight of anthraquinone with respect to the weight of the wood and annual plants.

4. A process as claimed in claim 3 comprising 15%–25% weight of sodium hydroxide.

5. A process as claimed in claim 3 comprising 20%–45% weight of alkali salts.

6. A process as claimed in claim 3 comprising 0.7%–1.5% weight of anthraquinone.

7. A method as claimed in claim 1 wherein the salts comprise sodium or potassium salts derived from benzenesulfonic acid, toluenesulfonic acid, o-, m-, p-xylenesulfonic acid, cymolsulfonic acid, benzoic acids, phthalic acids, formic acid and acetic acid.

8. A process as claimed in claim 1 wherein the cooking process is a continuous process.

9. A process as claimed in claim 1 wherein the cooking process is a discontinuous process, and wherein:

the cooking temperature is between 120° C. and 200° C.;

digesting time is between 30 minutes and 3 hours; and pressure is that given by vapor pressures at particular temperatures.

10. A process as claimed in claim 9 wherein the cooking temperature is between 160° C. and 190° C.

11. A process as claimed in claim 9 wherein digesting time is between 90 minutes and 150 minutes.

12. A process as claimed in claim 1 wherein partial oxidation in the water phase is obtained after separation of the lignin through precipitation with mineral acids.

13. A process as claimed in claim 1 wherein partial oxidation in the water phase is obtained after separation of the lignin through precipitation with carboxylic acids.

14. A process as claimed in claim 1 wherein partial oxidation in the water phase is obtained without separation of the lignin.

15. A process as claimed in claim 1 wherein partial oxidation is with air.

16. A process as claimed in claim 1 wherein the partial oxidation is with oxygen.

17. A process as claimed in claim 1 wherein partial oxidation in the water phase is conducted after separation of the hemicellulose contained in the cooking black liquor by ultrafiltration.

18. A process as claimed in claim 1 wherein partial oxidation in the water phase is conducted after separation of resins contained in the cooking black liquor by extraction.

19. A process as claimed in claim 1 wherein energy released through partial oxidation is used for the pulp digesting process.

20. A process as claimed in claim 1 wherein energy released through partial oxidation is used for the pulp bleaching process.

21. A process as claimed in claim 1 wherein energy released through partial oxidation is used for concentration by evaporation in order to maintain recovered digesting chemicals in a concentration adapted to the cooking process.

22. A process as claimed in claim 1 wherein the partial oxidation in the water phase is carried out in the following conditions:

(a) at temperatures between 120° C. and 350° C.;

(b) between pressure of 20 and 300 bars;

(c) in a residence time in the reactor from 1 to 120 minutes; and (d) with addition of air and/or oxygen.

23. A process as claimed in claim 22 wherein the temperature is between 180° C. and 300° C., the pressure is between 150 and 250 bars, and the residence time is between 5 and 60 minutes.

24. A process as claimed in claim 1 wherein the sodium hydroxide as well as the liquor resulting after separation from the carboxylic acids are returned back to the process.

25. A process as claimed in claim 1 wherein insoluble anthraquinone is filtered from the liquor resulting from the partial oxidation in water phase and is returned directly to the cooking process.

26. A process as claimed in claim 1 wherein the oxidized liquor obtained from partial oxidation in water phase is heated in a stripping stage in order to transform remaining sodium bicarbonate into sodium carbonate.

27. A process as claimed in claim 1 wherein the liquor obtained after the stripping stage is causticized with calcium oxide, to transform sodium carbonate into sodium hydroxide.

28. A process as claimed in claim 1 wherein the liquor resulting after separation from the carboxylic acids, containing the sodium hydroxide, the organic sulfonic acids, the remaining aliphatic carboxylic acids, and the soluble derivatives of anthraquinone, are returned back to the cooking process.

* * * * *

UNITED STATES PATENT AND TRADEMARK OFFICE

CERTIFICATE OF CORRECTION

PATENT NO. : 5,595,628
DATED : January 21, 1997
INVENTOR(S) : Gordon et al.

It is certified that error appears in the above-identified patent and that said Letters Patent is hereby corrected as shown below:

Title page,
Item [73], Assignee, change "Grant S.A." to -- Granit S.A. --.

Signed and Sealed this

Twelfth Day of August, 2003

JAMES E. ROGAN
*Director of the United States Patent and Trademark Office*